United States Patent [19]

Togo et al.

[11] Patent Number: 4,470,738

[45] Date of Patent: Sep. 11, 1984

[54] LIFTER IN A ROLLING DEVICE

[75] Inventors: Yoshiro Togo, Yokohama; Kengi Morimoto, Tokyo, both of Japan

[73] Assignee: Toyo Seikan Kaisha, Ltd., Japan

[21] Appl. No.: 265,352

[22] Filed: May 20, 1981

[30] Foreign Application Priority Data

May 21, 1980 [JP] Japan ..... 55-66412
Jun. 16, 1980 [JP] Japan ..... 55-80283

[51] Int. Cl.[3] ..... B21D 37/00

[52] U.S. Cl. ..... 413/37; 413/4; 413/6; 413/27

[58] Field of Search ..... 413/2, 4, 5, 6, 26, 413/27, 37; 53/368, 308

[56] References Cited

U.S. PATENT DOCUMENTS 2,362,840 11/1944 Mero ..... 413/37
3,006,304 10/1961 Renzi ..... 413/37
3,908,572 9/1975 Johnson et al. ..... 43/27

*Primary Examiner*—Leon Gilden
*Attorney, Agent, or Firm*—Jordan B. Bierman; Linda Bierman

[57] ABSTRACT

This invention relates to a novel lifter construction for rolling filled cans. It is designed to allow a lifter plate to effect relative rotation with respect to a lifter body to be forcibly driven in order to introduce the merits of the free rotation system into a lifter of prior art forced driving system. To this end, there is proposed a construction wherein the lifter plate is driven by a clutch and the clutch is disengaged with lifter pressure, and a construction wherein the lifter plate may be rotated through a given angle on the plate supporting bed. Preferably, a detector is provided to detect an abnormal rolling of cans or the like.

7 Claims, 8 Drawing Figures

LIFTER IN A ROLLING DEVICE

BACKGROUND OF THE INVENTION

1. Field of the Invention:

This invention relates to an improvement in rolling devices for filled cans, and particularly to a novel construction of a lifter and method for driving the same.

2. Prior Art:

Prior art lifters were of a forced drive system which is driven in synchronism with a chuck at all times, and of a free rotation system without the forced drive. In the free rotation system, a rapid rotation must be imparted to a can of a large volume filled with contents on the lifter, only by a seaming chuck during rolling, thus failing to achieve the rolling operation at high speeds. On the other hand, a forced drive system is advantageous in high speed operation but poses a disadvantage in that in the event a slip in the chuck or abnormal operation in rolling should occur for some cause, the lifter would not follow such a condition smoothly. This leads to a significant problem because a slight abnormality in the can or the like causes a great shock at a higher speed operation of rolling. A further problem is that a warm up operation at the time of start becomes necessary in order to provide smooth upward and downward movements of the lifter.

SUMMARY OF THE INVENTION

This invention relates to a rolling device having the merits of the aforementioned two driving systems of the prior art by providing a novel construction of a lifter, wherein the lifter is forcibly driven at least prior to the commencement of rolling, and relative rotation between a lifter plate and a lifter body is permitted to take effect during the rolling process.

That is, it is designed so that the lifter plate is driven through a clutch, and when pressure in excess of a given level is applied to the lifter plate during the rolling of a can, the clutch is disengaged to stop driving of the lifter plate, after which the lifter may follow the rotation of a seaming chuck in a manner similar to the free rotation system. This construction enables supplying a rotative force by which a filled can on the lifter may start its rotation rapidly and avoids the above-mentioned disadvantages with respect to forced driving of the lifter.

In another construction, the lifter plate is permitted to rotate relative to a plate supporting bed at a small angle. With this arrangement, it is possible to effectively absorb shocks which result from a difference in local rolling resistance of cans or the like, with respect to a seaming roll and a seaming chuck.

While the lifter may take either of two constructions as described above to achieve the object of the invention, the lifter may take both the constructions to achieve the object of the invention more completely.

The relative rotation between the plate supporting bed and the lifter plate occurs when an abnormal shock is applied during the rolling operation for some cause. Therefore, in the event a great relative rotation occurs, there is a great possibility that abnormal rolling is encountered in the can. Thus, a detector may be incorporated in which when the relative rotation exceeds a given angle, a signal is generated in response to said relative rotation, thereby detecting the abnormally rolled can.

DETAILED DESCRIPTION OF PREFERRED EMBODIMENTS

Figure 1:
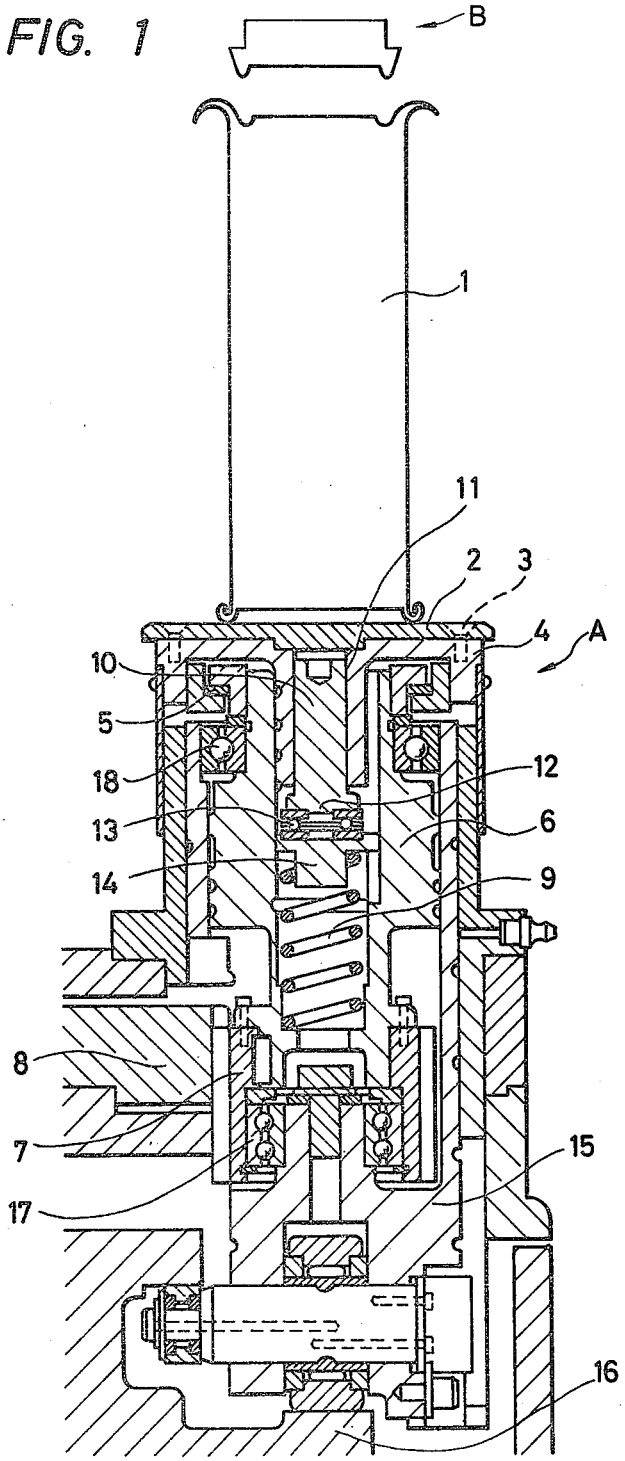
FIG. 1 is a sectional view of the lifter at a moment when a can is transferred onto the lifter.
Figure 2:
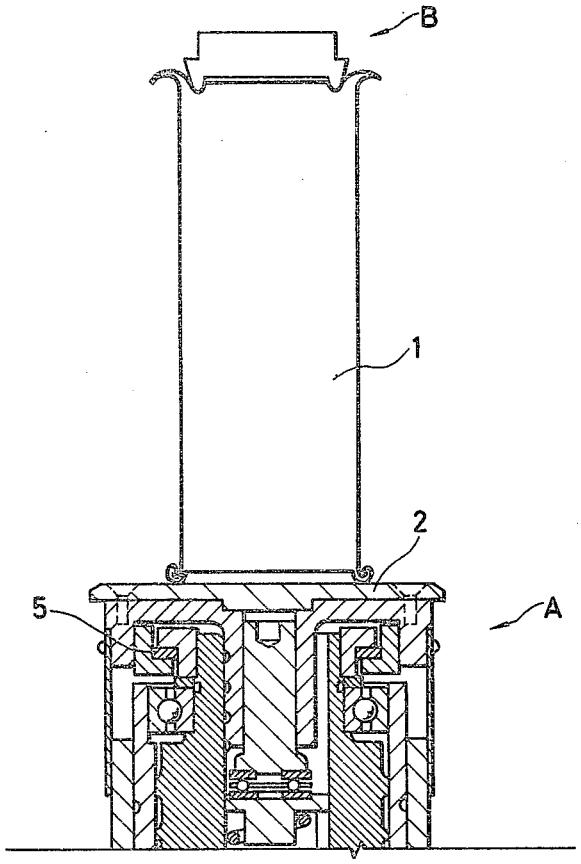
FIG. 2 is a partial sectional view of the lifter at a moment when a seaming chuck comes into contact with a can lid.
Figure 3:
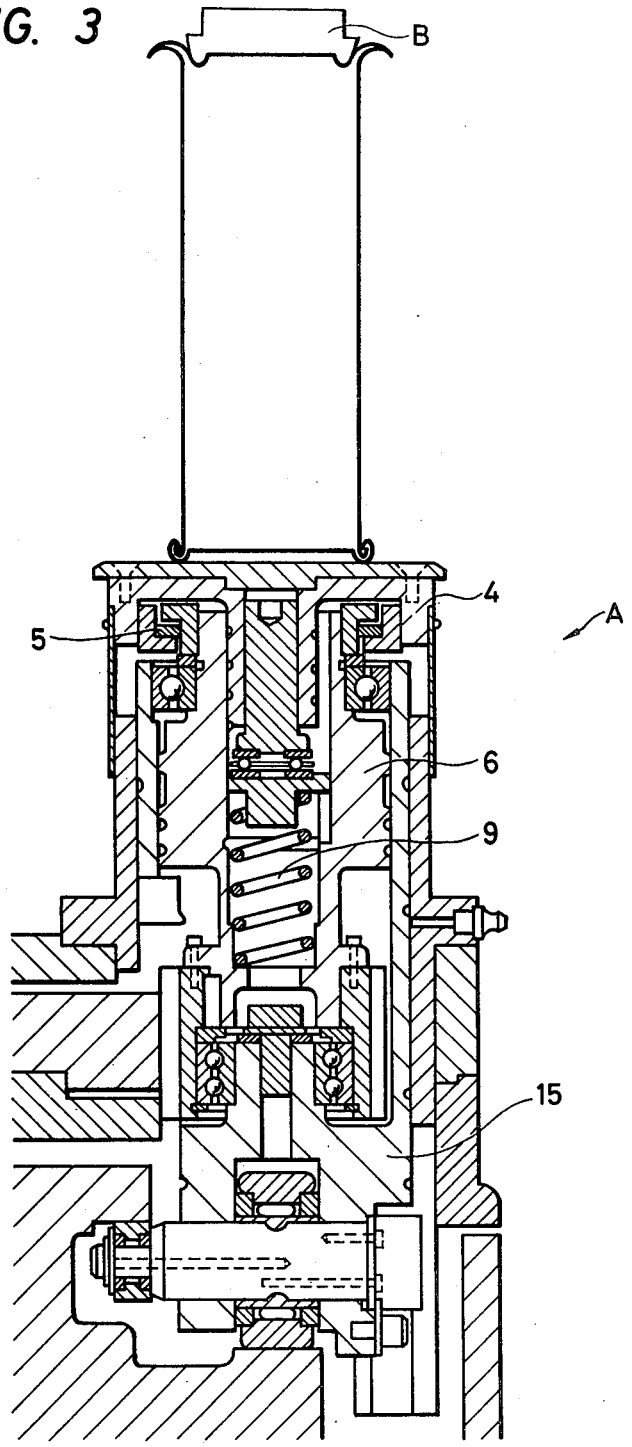
FIG. 3 is a sectional view of a lifter showing a condition where sufficient holding pressure is applied to the can.

Referring now to FIG. 1 which is a schematic sectional view showing a state when a can 1 transferred onto a lifter A reaches a seaming center. Reference numeral 2 designates a lifter plate on which a can is placed, the lifter plate 2 being fixedly mounted on a plate supporting bed 4 by means of screws 3 or the like. This plate supporting bed 4 has a frictional plate 5 mounted thereon which is clutch-coupled to a vertically movable rotatable member 6. A gear 7 mounted below the rotatable member 6 is meshed with a driving gear 8 driven by a motor (not shown). A spring 9 is retained within the member 6, and lifter pressure (pressure of the spring) acting on the lifter plate 2 is adjusted by means of a spring adjusting screw 10. The spring adjusting screw 10 is screwed into a hole 11 threaded in the plate supporting bed 4. A bearing 13 is mounted at the lower end 12 of the spring adjusting screw 10. In FIG. 1, reference numeral 14 designates a spring supporting member; 15, a lifter body for vertically moving the rotatable member 6 by means of a cam 16; and 17 and 18, bearings disposed between the member 6 and the lifter body 15. Reference character B designates a seaming chuck. As is known, the seaming chuck B is rotated by a gear (not shown) provided on the spline shaft (not shown) for driving the lifter A so as to synchronize with the lifter A, moved up and down by means of a cam, and moved down and rotated while pressing and holding a can body and a can lid during the rolling operation, as shown in FIGS. 2 and 3. Upon termination of the rolling operation, the seaming chuck B is moved up and rotated as shown in FIG. 1. FIG. 2 shows a moment when the can 1 is held between the lifter A and the seaming chuck B, the lifter A being still driven and rotated. FIG. 3 is a schematic sectional view showing a moment when lifter pressure greater than spring pressure is applied with the can 1 held between the lifter A and the seaming chuck B, in which the clutch-coupling between the lifter plate 2 and the member 6 is released to rotate the lifter A in its free condition.

With the arrangement as described above, since the lifter A in accordance with the present invention is rotated through the driving gear 8 mounted on the spline shaft driven by the motor (not shown) and the gear 7 mounted on the rotatable member 6, the member 6 rotates. Also, since the member 6 is clutch-coupled to the plate supporting bed 4, as shown in FIG. 1, the lifter plate 2 fixedly mounted on the plate supporting bed 4 has the can 1 placed thereon to rotate the latter when it is not held by the seaming chuck B. Next, the seaming chuck B is moved down and rotated while pressing the can 1, as shown in FIG. 2, but since the rotatable member 6 is clutch-coupled to the plate supporting bed 4, the lifter A is continuously driven and rotated. Subsequently, when the lifter body 15 is moved up by the cam 16, the rotatable member 6 also moves up to release the clutch-coupling between the member 6 and the plate supporting bed 4, so that the plate supporting bed 4 assumes a free state as shown in FIG. 3 and is rotated by rotation of the seaming chuck B. Upon termination of the rolling operation, the lifter body 15 is moved down as shown in FIG. 1 to again provide the clutch-coupling between the rotational member 6 and the plate supporting bed 4 to cause driving and rotation of the lifter A.

In the present invention, since a clutch mechanism is provided between the plate supporting bed 4 of the lifter A and the rotatable member 6, upward and downward movements of the lifter A may be achieved smoothly, rarely requiring warm up running at the time of starting, the warm up running may be reduced materially, slip of the chuck and abnormal rotation of the seaming roll may be decreased materially, abnormal rolling of canned cans may be decreased materially in case the rolling device is operated at high speeds, and thus, reliability of the rolling operation may be increased.

Further, since the spring adjusting screw 10 is provided on the plate supporting bed 4, the lifter pressure (spring pressure) acting on the lifter plate 2 may be adjusted freely.

While, in the illustrated embodiment a frictional clutch is employed to provide intermittent driving of the lifter plate 2, it will be of course understood that such element is not limited to the frictional clutch shown and described, but mechanisms by which transmission of a driving force is cut off by loads in excess of a predetermined level can be extensively utilized.

Figure 4:
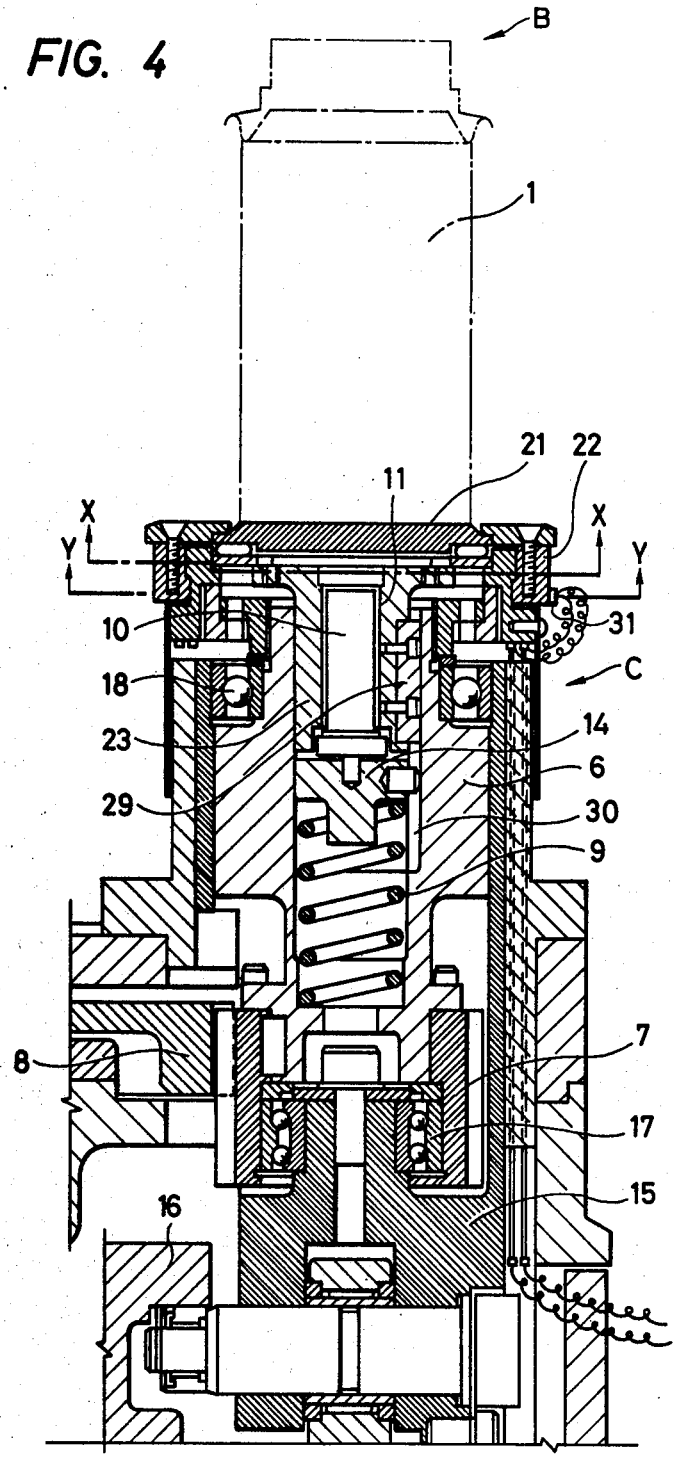
FIG. 4 is a sectional view showing another embodiment in which a lifter plate is permitted relative rotation.
Figure 5:
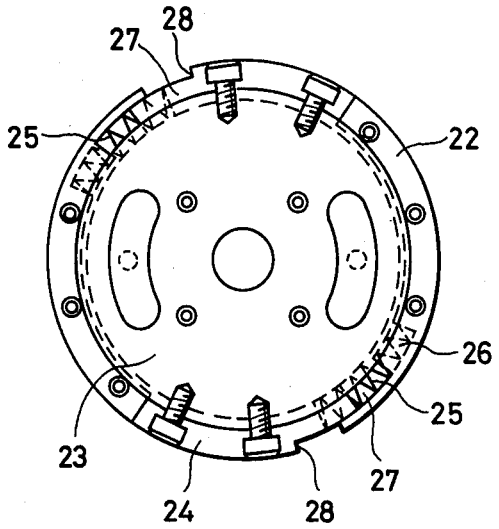
FIG. 5 is a sectional view taken along line x—x of FIG. 4.
Figure 6:
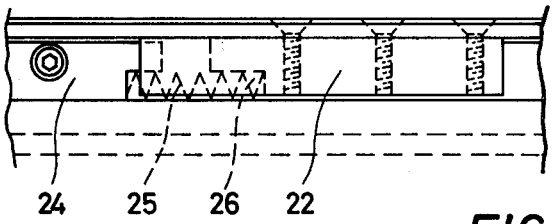
FIG. 6 is an enlarged side view of a portion in which a spring is retained in FIG. 5.
Figure 7:
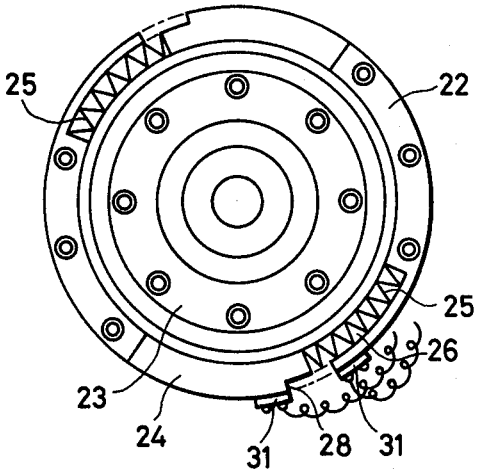
FIG. 7 is a sectional view taken along line y—y of FIG. 4.
Figure 8:
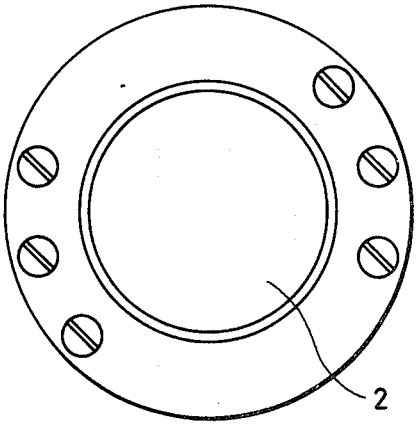
FIG. 8 is a plan view of the lifter of FIG. 1.

FIG. 4 shows a further embodiment, in which the lifter plate 2 is not directly fixed by the screws 3 to the plate supporting bed 4 but a spring is interposed therebetween to allow relative rotation at a given angle.

FIG. 4 is a schematic sectional view showing a state where lifter pressure in excess of spring pressure is applied with a can 1 held between a lifter C and a seaming chuck B. In FIG. 4, reference numeral 21 designates a lifter plate on which a can is placed, the lifter plate 21 having a fixed member 22 secured thereto in a suitable manner. This fixed member 22 is connected by means of a spring 25 to a fixed member 24 secured to a plate supporting bed 23 in a suitable manner. The fixed member 24 has also an extreme end 27 formed to have a smaller width so that the former may be rotated within a cut groove 26 of the fixed member 22. A stop 28 is provided to prevent rotation of the fixed member 24 in excess of a predetermined amount. The plate supporting bed 23 is keyed by means of a key 29 to a vertically movable rotatable member 6. As in the previous embodiment, a gear 7 mounted below the rotatable member 6 is meshed with a gear 8 driven by a motor (not shown). A spring 9 is retained within the member 6, and lifter pressure (pressure of spring) acting on the lifter plate 21 is adjusted by means of a spring adjusting screw 10. The spring adjusting screw 10 is screwed into a hole 11 threaded in the plate supporting bed 23. In FIG. 4, reference numeral 30 designates a key way; 14, a spring supporting member; 15, a lifter body for vertically moving the member 6 by means of a cam 16; and 17 and 18, bearings disposed between the rotatable member 6 and the lifter body 15. Further, a detection device such as a limit switch 31 is mounted on the fixed member 24 secured to the plate supporting bed to detect rotation of the plate supporting bed 23 in excess of a given allowable amount of displacement.

With the arrangement as described above, in the lifter C of the present invention, since the driving gear 8 mounted on the spline shaft driven by the motor (not shown) is meshed with the gear 7 mounted on the rotatable member 6, the member 6 rotates. Also, since the rotational member 6 and the plate supporting bed 23 are keyed by means of the key 29, the plate supporting bed rotates also. Since the plate supporting bed 23 is connected to the lifter plate 21 by means of the spring 25, the lifter plate 21 rotates also. Next, the seaming chuck B is moved down to rotate the can 1 while pressing thereof whereas the lifter body 15 is moved up by means of the cam 16 and the rotational member 6 is moved up to drive and rotate the lifter C.

In the present invention, the lifter plate 21 and the plate supporting bed 23 are connected by the spring 25 and thus, if a difference in rotation occurs between rotation transmitted form the seaming chuck B and rotation transmitted from the lifter C, the spring 25 is subjected to elastic deformation to follow and synchronize with the rotation transmitted from the seaming chuck. With this, not only a twisting load is not applied to the can lid, but a slip occuring between the chuck and lid, between the can and can body and between the can bottom and lifter is completely prevented to thereby accomplish a good rolling operation. In addition, since the abnormal-state detector is provided in the fixed member 22, it is possible to promptly detect abnormal rolling of cans or the like to alert an operator of presence of defective articles and easily effect automatic selection thereof.

Abnormal-state detecting devices incorporated into the lifter in accordance with the present invention, which can be utilized, include various electromagnetic and optical alarms and position detectors such as signal generators, light emitting units and so on. Moreover, while the lifter plate and the plate supporting bed are connected by means of the spring in the illustrated embodiment, it will be of course understood that such a connection is not limited thereto, but elastically deformable transmission mechanisms may be utilized extensively.

What is claimed is:

1. In a rolling device for sealing closure of cans, including a seaming chuck for contact with the top end of a can to be sealed and operably driven to rotate the can for sealing closure thereof, an improved lifter comprising:

a lifter plate for receiving thereon the bottom of a can to be sealed;

a plate supporting bed upon which said lifter plate is mounted;

a driven rotatable member;

clutch means between said rotatable member and said plate supporting bed for coupling the same to cause driven rotation of said plate supporting bed and thereby promote smooth rotation of the can in conjunction with the seaming chuck; and lift means for effecting relative movement of said plate supporting bed toward the seaming chuck to thereby firmly clamp the can between the seaming chuck and said lifter plate for sealing closure thereof, and for disengaging said clutch means to uncouple said rotatable member and said plate supporting bed as said bed is relatively moved toward the seaming chuck so that during seaming closure of the can rotation is imparted thereto by the seaming chuck alone.

2. In a rolling device in accordance with claim 1, spring means in said rotatable member for imparting an upward urgency to said plate supporting bed.

3. In a rolling device in accordance with claim 2, means for adjustably tensioning said spring means to selectively control the upward urgency imparted to said plate supporting bed.

4. In a rolling device in accordance with claim 1, spring means connecting said plate supporting bed and said lifter plate for enabling relative rotation therebetween as the rotation of said plate supporting bed is imparted to said lifter plate.

5. In a rolling device in accordance with claim 4, means for detecting relative rotation in excess of a predetermined amount between said lifter plate and said plate supporting bed.

6. In an improved lifter of a rolling device for sealing closure of cans, a horizontal lifter plate supporting bed rotatably driven for facilitating sealing closure of a can, a horizontal lifter plate for receiving thereon a can to be sealed, relatively rotatably supported on said bed, and horizontally disposed spring means interconnecting said lifter plate and said supporting bed for enabling limited relative rotation therebetween so that differences in the rotative speeds of said supporting bed and the can during sealing closure of the can are accommodated by said spring means.

7. In an improved lifter in accordance with claim 6, means for detecting relative rotation in excess of a predetermined amount between said lifter plate and said supporting bed.

* * * * *